United States Patent [19]

Torrey

[11] Patent Number: 5,044,690

[45] Date of Patent: Sep. 3, 1991

[54] FOLDING STOOL

[76] Inventor: Ralph H. Torrey, 3500 Dry Creek Rd., Marietta, Ga. 30062

[21] Appl. No.: 493,404

[22] Filed: Mar. 14, 1990

[51] Int. Cl.[5] ..... A47C 4/00; A47D 1/02

[52] U.S. Cl. ..... 297/16; 297/45; 297/439; 297/441; 108/119; 108/124

[58] Field of Search ..... 297/16, 45, 439, 441; 108/119, 124, 115

[56] References Cited

U.S. PATENT DOCUMENTS

| | | | |
|---|---|---|---|
| 181,225 | 8/1876 | Travis | 248/434 |
| 476,805 | 7/1892 | Mason | 108/157 |
| 615,135 | 1/1898 | Bowman | 108/128 |
| 1,134,057 | 3/1915 | Neff | 108/128 |
| 1,157,795 | 2/1915 | Mix | 108/157 |
| 1,215,689 | 5/1917 | Neff | 108/113 |
| 1,390,836 | 9/1921 | Stool | 108/157 |
| 4,482,186 | 11/1984 | Gomes | 297/441 |
| 4,544,203 | 10/1985 | Younger et al. | 297/439 |

*Primary Examiner*—Kenneth J. Dorner
*Assistant Examiner*—Milton Nelson, Jr.

[57] ABSTRACT

A folding stool comprising a pair of hinged seat supports (10) connected to a pair of hinged leg supports (22) by way of a pair of pivots (26) in such a manner that the leg supports fold up into and fit within the seat supports thus making a compact package convenient to carry and store. Hinged leg supports and hinged seat supports cross each other at the point of the pivots in substantially X form when stool is open and in use. The leg supports are connected to each other by means of a flexible double acting hing (24) permitting rotation of the leg supports over the 180° horizontal and, moving in concert about the pivots, leg supports and seat supports are brought into a position suitable for supporting an adult user at a comfortable, normal chair height. The dimension representing seat height when stool is in use is substantially greater than the longest dimension of the folded package.

A readily detachable and foldable seat (14) stretches across the top of and engages the seat supports preventing further opening of the stool while also holding support members in controlled and firm adjustment when stool is in use and under stress. With stool folded, seat fits snugly between folded support members presenting a compact package convenient to carry and store.

9 Claims, 4 Drawing Sheets

FOLDING STOOL

BACKGROUND

1. Field of the Invention

This invention relates to folding chairs and stools, specifically to an improved design for a folding stool which in its folded state makes a small and compact package and which when opened permits the user to sit at normal chair height.

2. Description of Prior Art

From ancient times man has found it useful to have a simplified backless chair or stool to sit upon, especially for brief periods, and long ago he discovered the advantage of portability of such a piece of furniture. A stool which could be folded into a compact size and shape, while also sufficiently strong and serviceable, became the object of numerous inventors.

Many different variations of the folding stool have been developed over the years, but relatively few have survived in the marketplace. The principal reasons for lack of commercial acceptability include: complexity or relative impracticality of design, expense of manufacture, and lack of aesthetic appeal. Those types which have remained acceptable in the marketplace are used for such diverse activities as camping, fishing, hunting, hiking, by artists painting in the field, by spectators at sporting events and games such as baseball, football, soccer, in watching horse racing, auto racing and the like, in watching golf tournaments, parades, for walks in the woods and for strolls by the elderly. In such and similar uses a compact folded size and shape, reasonably light weight, and reasonably attractive appearance are important considerations, along with, of course, comfortable sitting.

Probably the simplest form of the folding stool and the oldest is the familiar camp stool whose frame and support members sometimes of wood and now more commonly of tubular steel or aluminum, form an inverted U-shape. Two such U-shaped parts are pivotally connected by means of pins or rivets disposed at approximately the middle of their vertical sides, allowing the two parts to open into an X-shape, with an attached flexible seat, usually of canvas or duck, stretching across the top of the X and preventing further opening of the stool. When folded, the two U-shaped parts close one against the other, with the flexible seat folded or tucked in between the folded frame parts.

Functionally this design derives from the X-shaped supports used in chair design for centuries in many different countries and cultures, including Chinese, Egyptian and Roman. It was but a short step in concept to making the support members collapsible or foldable. Hence, this design and its contemporary adaptations in folding stools are of ancient heritage. Its continued success rests on factors of simplicity, practicality and low cost.

Yet, there are objections to this familiar design. Aesthetically such a stool cannot be said to be attractive to carry about, for example at golf tournaments, although it is practical to use and inexpensive to make. Aesthetic considerations aside, a more serious objection is the size and shape into which this stool can be folded for carrying and storing. If the stool were made so that the user could sit at normal chair height (17" or 18"), the vertical leg members would have to be 22" or 23" in length. Typical width of the seat frame is 10". Dimensions of the folded stool would then approximate 10"×22" or 10"×23", with the thickness of the package determined by the thickness of the legs in their folded state. This is not a desirable size or and attractive package for carrying about.

When the maximum folded dimension of the aforementioned design is made smaller than 10"×22", the seat height becomes lower. When the folded package is made of a size considered reasonably desirable for carrying about, the seat height is lowered to a point where the stool becomes significantly less convenient to use. Those less physically fit, and older users in particular, find some difficulty in lowering themselves to the required level for sitting, or they may simply perfer not to.

Another device sometimes used in spectator activity is the "shooting stick", used in England and Europe beginning in the nineteenth century and later in the U.S. This portable seat is convenient in that it can readily be carried like a cane. The device is essentially a metal tube or post with a folding seat on one end a spike with flange on the other end. It has contemporary variations with the tube made of aluminum and an aluminum seat frame, the folding seat of leather or fabric, or with a "flip-top" hinged seat of rigid plastic, with a handle formed by or cut out of the seat. The main objections to this type of portable seat are: (a) the seat is quite small and not comfortable to use for any length of time and (b) the single leg or post obliges the user while seated to brace himself or herself with his or her own two legs spread out in a particular way, thus forming the second and third legs of a tripod, so to speak. Bracing oneself thus can become tiresome.

Another type of stool, probably thought to be an improvement over the "shooting stick", has a principal leg or post in the shape of a cane, with a crook at the top to serve as a handle, and with a hinged seat and two additional legs pivotally connected to the principal leg so as to fold against it. The result is a cane with cumbersome and ungainly attachments.

The folding stool invented by Neff and patented in 1917 (U.S. Pat. No. 1,215,689, which itself is an improvement over U.S. Pat. No. 1,134,057 issued in 1915, also to Neff) is intended to be folded and carried in a coat pocket. In the size as marketed, the user is obliged to lower himself to a seat height of about 14", a necessity objectionable to many users. The frame of this stool is made of heavy galvanized steel wire and hence the stool is not aesthetically attractive. If the stool were made in larger dimensions so that the user could sit at a more comfortable height, the stool would become more ungainly in size and appearance. An additional important objection is the necessity to use links and connectors which must be set or attached both horizontally and vertically in order to provide necessary bracing.

Several other patents appear to be relevant to my invention:

Travis, U.S. Pat. No. 181,225 (1876) discloses a folding chair which is a combination of folding seat with supporting frame comprised of hinged and pivoting parts. However, Travis does not show a set of support members which are connected by a double acting hinge which permits pivoting of the support members about a pair of axles over the 180° horizontal, as will be shown in my invention. The Travis chair, moreover, cannot provide seating at a comfortable and normal chair height while also allowing the folding of the chair into a compact size and shape.

The Mason U.S. Pat. No. 476,805 (1982) and Mix U.S. Pat. No. 1,157,795 (1915) both show a folding stool having a central post to which are pivotally connected supporting bars or legs by means of a fixed and slidable pair of sleeves or rings. Both employ systems to lock the sleeves in position on the central post when the stool is open for use.

Stoll, U.S. Pat. No. 1,390,836 (1921) is similar to Mason and Mix in that a post is used as a central support. Two pivot assemblies are positioned by a wing nut disposed on the bottom portion of the central post, which is threaded. The wing nut is rotated up the post, the lower pivot is brought into proximity with the upper pivot, thereby stretching the seat cover.

Bowman U.S. Pat. No. 615,135—1898) describes a folding stool having four pairs of bars connecting to a central pivot. There is an interlocking ratchet with pin that locks the stool in an open position, thereby preventing the stool from collapsing under the weight of the user.

The Neff, Bowman, Mason, Mix and Stoll stools are all made of a size that when folded are small enough to be carried in a coat pocket. Accordingly, they all have the objection of the previously mentioned low seat height. They would all likewise be of ungainly proportions if made to provide a comfortable seat height. Moreover, if any of them had sufficient appeal in terms of design, features and performance, one or more of them would likely be on the market today.

OBJECTS AND ADVANTAGES

My invention is functionally different from the above mentioned types of folding chair or folding stool and from all other folding chairs and stools of which I am aware. In addition, my invention overcomes the objections and limitations noted in connection with my discussion above of other types of folding stools.

Accordingly, objects and advantages of my invention are:

(a) to provide a folding stool which may be readily collapsed or folded into compact form convenient to carry and store (b) to provide a folding stool which permits the user to sit comfortably at normal chair height (17" or 18")

(c) to provide a folding stool which is sufficiently strong and sturdy to support a 250-pound adult, yet light in weight and convenient to carry about (d) to provide a folding stool which offers aesthetic appeal both in its folded form and when opened and in use (e) to provide a folding stool which has a potentially long service life (f) to provide a folding stool with a seat which may be readily and inexpensively replaced (g) to provide a folding stool which offers space and means to accommodate readily the names, logotypes and slogans of advertisers (h) to provide a folding stool which may be readily manufactured and assembled at a cost supportable in marketing the product (i) to provide a folding stool which through a combination of features, appearance and price is rendered uniquely attractive to potential users and hence desirable in the marketplace Further objects and advantages will become apparent from consideration of the drawings and descriptions which ensue.

DRAWINGS AND FIGURES

The accompanying drawings and figures show the folding stool of the present invention in a preferred configuration.

REFERENCE NUMERALS AND LETTERS USED IN DRAWINGS

Figure 1:
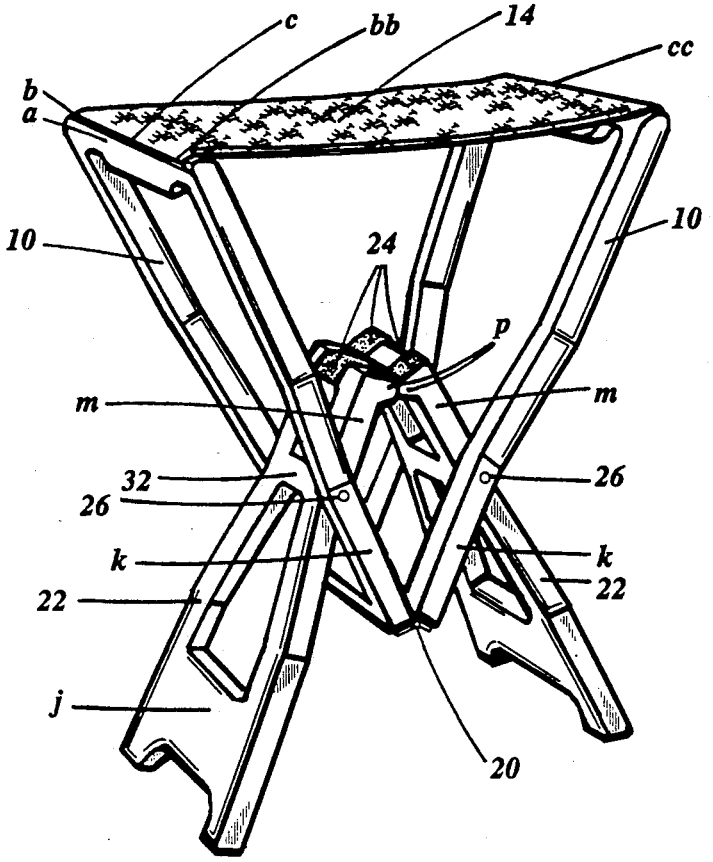
FIG. 1 shows the folding stool in its open form ready for use.

Numerals are used for folding stool parts. Like numbers represent like parts.

Lower case letters are used for locations in the drawings. (E.g., b indicates one end and bb represents the opposite end of slot 12 in seat support 10.)

Capital letters are used as suffixes with numerals to distinguish like parts in certain descriptions. (E.g., 24A, 24B and 24C are the three parts of double acting hinge 24 and are distinguished in FIG. 6 to show manner of attachment of double acting hinge.)

REFERENCE NUMERALS AND LETTERS IN DRAWINGS

10—seat support
12—slot in seat support
14—flexible seat
16—slat encased in seat end
18—screw holding one seat end in slot
20—continuous hinge
22—leg support
24—double acting hinge
26—pivots or axles
28—washers
30—reinforcing dowels
32—cross brace of leg support enclosing axle
a—top horizontal portion of seat support 10
b—end of slot 12
bb—opposite end of slot 12
c—end of seat 14
cc—opposite end of seat 14
d—location of reinforcing dowels when used
f—location of continuous hinge 20
g—location of double acting hinge 24
h—cutout for hand to permit grasping of the stool
j—space for name or logotype
k—sides of seat supports 10
m—sides of leg supports 22
n—outer edges of flexible seat 14
p—nose or protrusion in shape of leg supports 22
s—folded edge of seat 14.

DESCRIPTION—FIGS. 1 TO 6

A typical embodiment of the present invention is shown in FIGS. 1 to 6.

Figure 5:
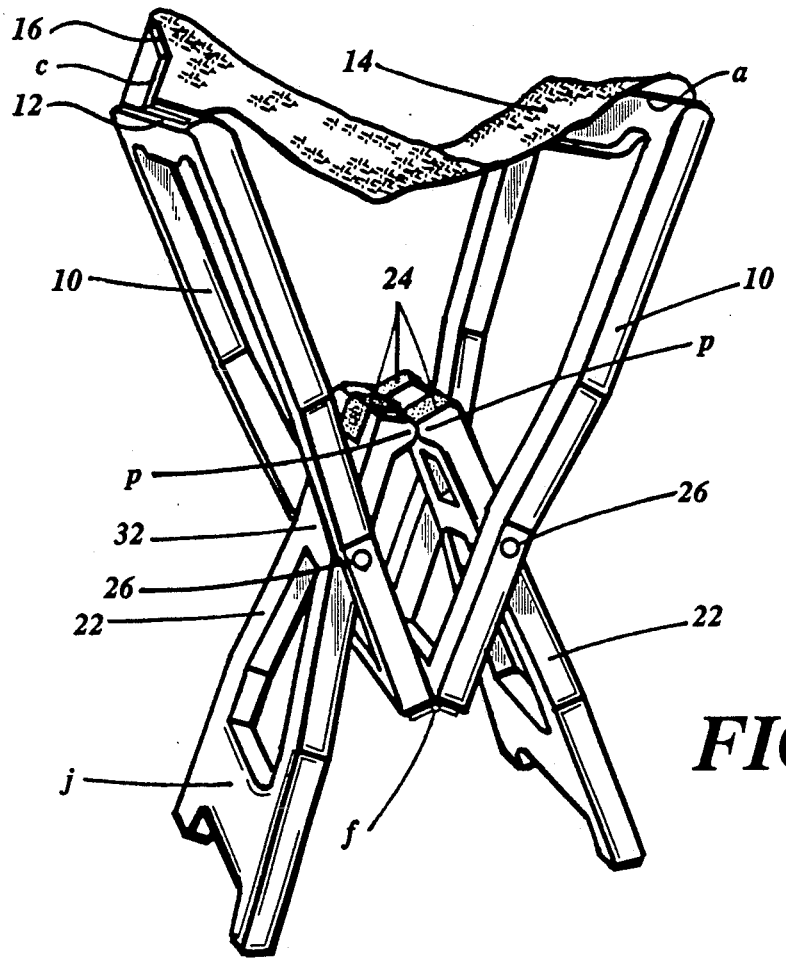
FIG. 5 shows the stool with leg supports extended downward and seat supports partially closed to permit reinsertion of seat end, thus readying stool for use as depicted in FIG. 1. (Note that in refolding stool the steps depicted in FIGS. 1 to 5 are simply reversed.)

Referring first to FIG. 1 and FIG. 5, the folding stool has two seat supports 10, of like size and shape and interchangeable, each with a slot 12 cut into the top of horizontal portion a of the seat supports. These slots are of uniform width and depth and run from b to bb in top portion of the seat supports. Slots are there to receive the ends c and cc of flexible seat 14. Ends c and cc of seat 14 have encased within them a rigid or semi-rigid slat 16 of thin wood or plastic or material of like properties. When seat ends have been inserted in the slots, and with stool open and in use, the stretched seat forms an acute angle with slat encased seat ends. This acute angle insures that seat ends stay in place in their slots when stool is in use and under stress from the weight of the user. There is no tendency whatever for seat ends to slip out of their slots when stool is in use and under stress. When seat is thus secured as described, stool is also prevented from opening further.

One end of the seat is held in place in its slot by means of a single screw or pin, while the other end of the seat is removable from its slot for purposes of folding and unfolding the stool.

The shape of flexible seat 14 is such that when folded and tucked between seat supports 10 when stool is in its folded state (see FIG. 2) it corresponds exactly in shape to that of folded seat supports 10. The outer edges n of folded seat 14 match exactly outer edges of folded seat supports 10. The length of seat 14 measured from c to cc in FIG. 1 is approximately 14½" in the embodiment shown. This 14½" dimension is somewhat arbitrary, but the actual dimension used is important in that it controls the height of the stool when it is opened and in use.

As earlier stated, one of the two seat ends (cc in FIG. 1) is held in place in slot 12 by means of a single screw 18 (FIG. 2), so that the other seat end c, identified to the user by a prominent white dot, is the end inserted and removed from its slot for folding and unfolding of the stool. When the single screw is removed, the entire seat becomes easily removable for cleaning or replacement as necessary.

Seat supports 10 are connected to each other at f by means of a continuous hinge 20, which permits opening of seat supports to a full 180°.

Figure 6:
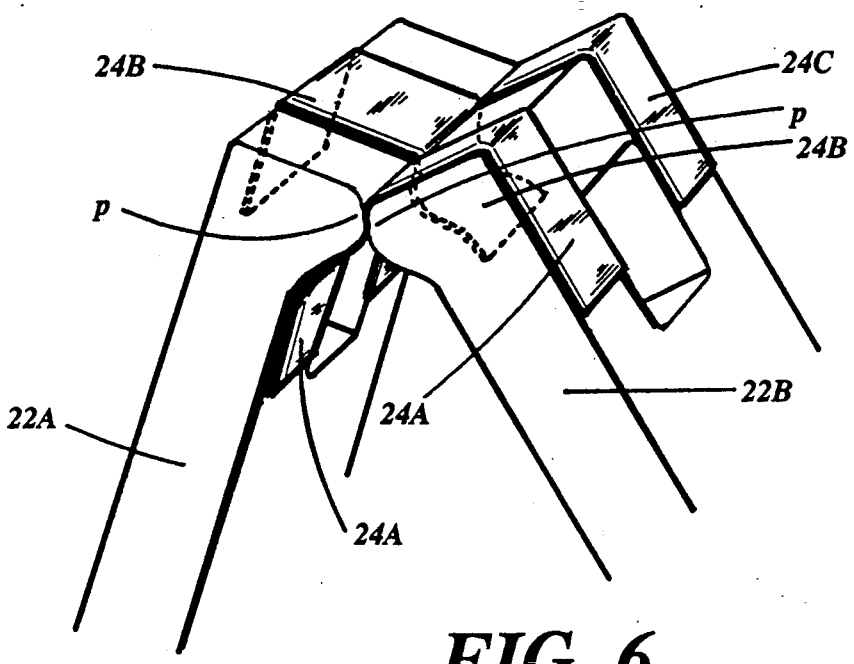
FIG. 6 is a close-up view of double acting hinge to show manner of attachment of the hinge.
Figure 7A:
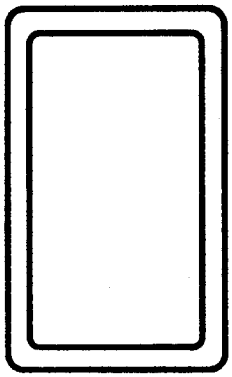
FIG. 7 shows six of many possible variations in shape of support members.
Figure 7B:
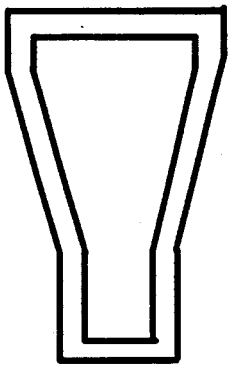
Figure 7C:
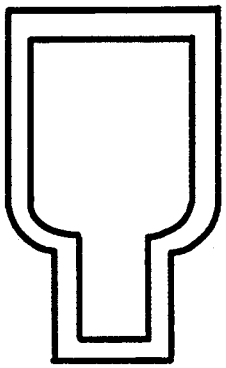
Figure 7D:
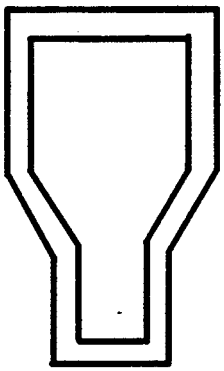
Figure 7E:
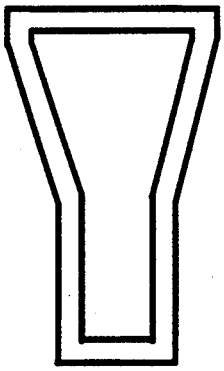
Figure 7F:
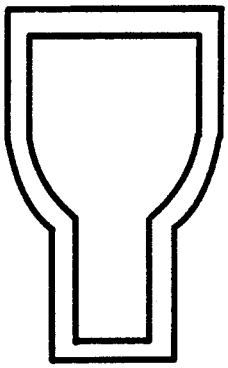

Two leg supports 22, of like shape and size and interchangeable, are connected to each other at g (FIG. 2) by means of a flexible double acting hinge 24. In a typical embodiment hinge 24 consists of 3 parts, 24A, 24B and 24C, attached in the manner shown in FIG. 6. It can be seen that one side of one end of 24A (we will call it the face) is attached to leg support 22A and the reverse side of the opposite end of 24A (we will call it the back) is attached to leg support 22B. Similarly, the face of 24C is attached to leg support 22A and the reverse side of the opposite end of 24C (the back) is attached to leg support 22B. Finally, the third part of double acting hinge 24, identified as 24B in FIG. 6, is attached to leg supports in this way: the face of one end of 24B is attached to 22B and opposite end of 24B is attached to leg support 22A. In this manner of attachment leg supports are firmly connected to each other and in concert with axles 26 are permitted to pivot a full 180° without play or wobble at any point during the course of their movement.

Figure 2:
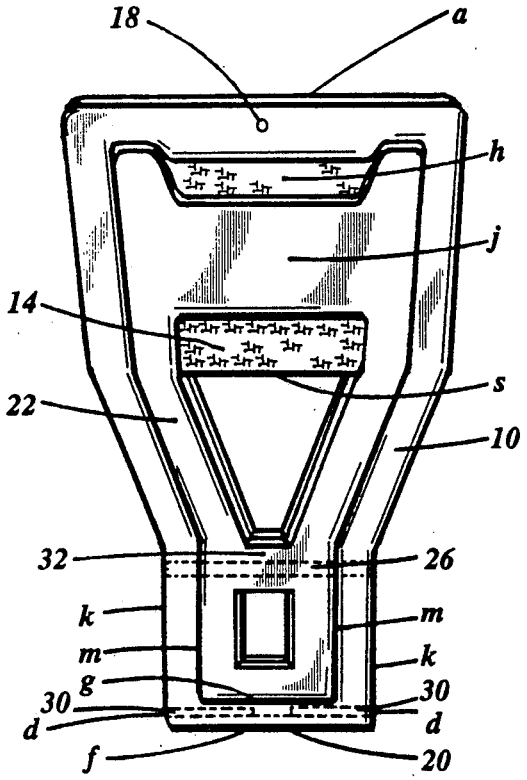
FIGS. 2 and 2A show three views of the stool folded into a compact package ready to be carried or stored.
Figure 2A:
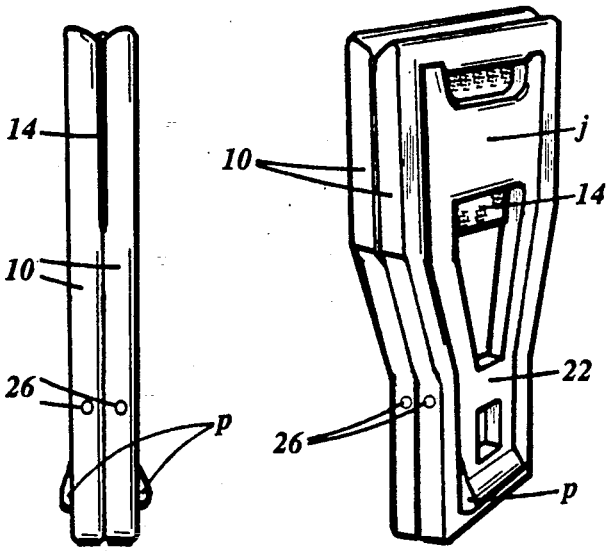
Figure 4:
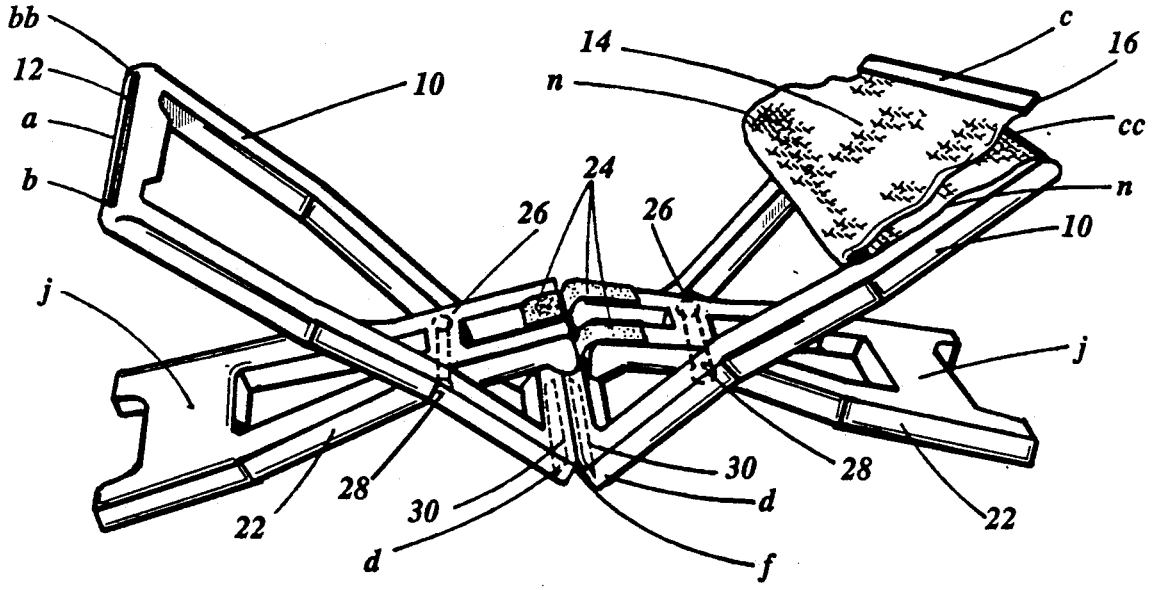
FIG. 4 shows the stool opened fully to allow the two leg supports, pivoting on axles and double acting hinge, to fall of their own weight into position for use.

Leg supports 22 are connected to seat supports 10 by means of axles 26 identified in FIGS. 1, 4 and 5. Axles 26 are disposed at a point intermediate of the extremities of seat supports 10. In the embodiment shown axles 26 are disposed at a distance from bottom f of seat supports 10 equivalent to about one fourth the distance from top a of seat support 10 to bottom f of seat support, as shown in FIG. 1. Location of the axles relative to top and bottom of seat supports 10 is variable to a degree, but the closer they are disposed to bottom f of the seat supports, the less stable does the structure become. On the other hand, the further the axles are disposed from bottom f of seat supports 10, the lower will the seat height become when the stool is opened for use. In the present embodiment seat supports measure 14½" in their extremities, and the distance from f to axle 26 is 4", and this dimensional relationship is considered very satisfactory. Axles 26 are centered within the space representing the thickness of seat supports 10 and pass through and secure leg supports 22 at center of cross brace 32, as seen in FIG. 1 and FIG. 5. Location of axle holes in leg support members 22 is determined by location of axle holes in seat support 10, inasmuch as leg support members fit completely within seat support members in the stool's folded state, as shown in FIG. 2.

With all frame members firmly connected by hinges and axles as described and shown in drawings, the assembly is permitted to change from compact folded state (FIG. 2) to fully open state (FIG. 4) and thence to in-use state (FIG. 1) in a smooth movement without play or wobble at any point during the course of this movement. With seat in place, stool is prevented from opening further and is ready for use as shown in FIG. 1. In the present embodiment seat height of the open stool is 18", considered to be normal chair height and a comfortable sitting height for adults. Moreover, this dimension is 24% greater than the longest dimension of the folded package.

Attention is now drawn to point p in FIGS. 1 and 6, which identifies a protrusion common to both leg supports 22. The purpose of this protrusion or nose is to force the connected portion of leg supports 22 further apart when stool is opened and in position for use, which action also has the effect of forcing the leg support members into a somewhat more vertical attitude when the stool is ready for use. The more vertical attitude or stance of the leg supports adds significantly to the strength of the assembly in terms of its ability to support weight. In the embodiment as illustrated and constructed of wood, the stool readily supports an adult of 250 pounds.

Cross section of support members (seat supports 10 and leg supports 22) as shown in the embodiment made of solid wood and illustrated in FIGS. 1 to 6 are ¾"×1". In other embodiments such as plywood, the cross section of frame support members may vary from ⅝"×⅞" to ¾"×¾", or other dimensions in this general range.

When made of solid wood, such as basswood or alder, reinforcing dowels are used at four corners d in seat supports 10. Reinforcement is not needed at these points when plywood is used, or when support members are made of appropriately selected plastic or metal.

Weight of the stool of the present invention when made of wood and in the embodiment as discussed and shown in the drawings approximates 2½ pounds.

OPERATION—FIGS. 1 TO 5

The following is intended as a brief review of the operation of the stool of the present invention.

Figure 3:
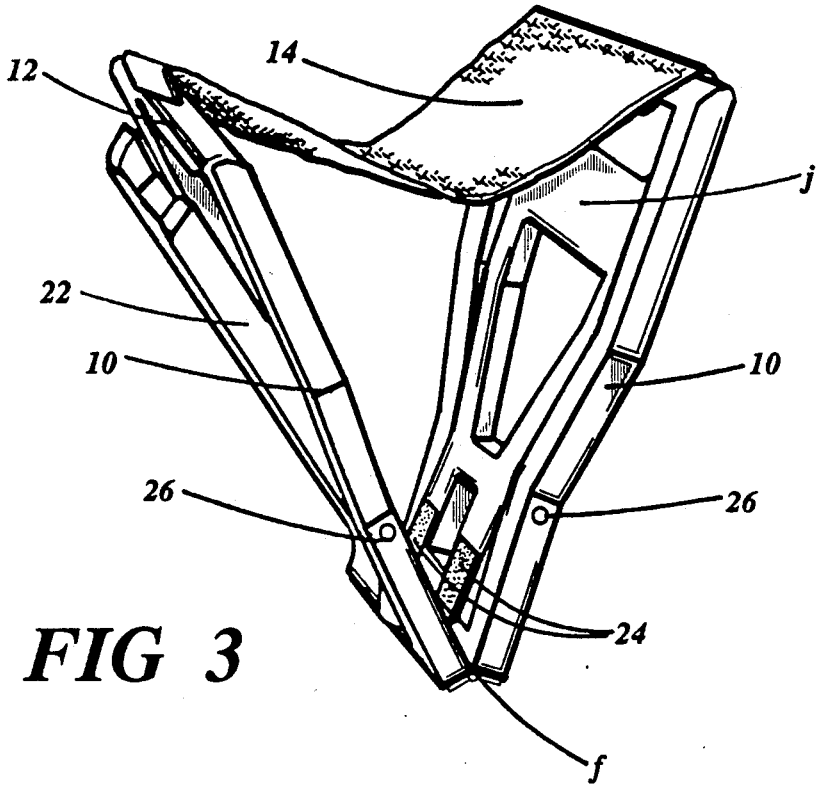
FIG. 3 shows the stool having been partially opened preparatory to readying it for use, with seat end partially removed from top of seat support.

From its folded state (FIG. 2), seat supports 10 are opened as in FIG. 3, pivoting on continuous hinge 20, while leg supports 22 begin their pivoting on axles 26 and double acting hinge 24, a simultaneous action. Flexible seat 14 had been folded in half and neatly tucked between seat support members when stool was folded. When stool is opened slat encased seat end c is momentarily removed from slot 12 in top of seat support 10. Removal of seat end permits full unfolding of stool as shown in FIG. 4, with leg supports 22 allowed to drop of their own weight into proximate position for use. Seat end c is then promptly reinserted into slot 12 preventing further opening of the stool. Fully opened, with seat in place and stretched taut, stool is ready for use (FIG. 1). The opening operation can be easily and smoothly accomplished in three or four seconds.

Because rigid seat ends c and cc, inserted in their respective slots in top of seat supports 10, have formed an acute angle with the stretched seat itself, slat encased seat ends stay in their slots under all degrees of stress from the weight of the user. Yet, when the stool is to be folded for carrying or storing, slat encased seat end c (FIG. 5) can be readily removed from slot 12. In folding action, one end of seat is removed from its slot, seat supports are momentarily opened fully as shown in FIG. 4, leg supports are folded back up into seat support members, seat end c is reinserted into slot in top of seat support 10, and flexible seat 14 is tucked neatly between seat supports for carrying and storing. The folding action can be readily accomplished in four or five seconds.

Slat encased seat end c (FIG. 5) fits snugly into its slot in top of seat support 10 with a slight frictional resistance, so that at rest under no strain or stress there is no tendency for seat end to fall out of its slot even when stool is turned upside down or otherwise handled.

There is a space identified as h in FIG. 2 for grasping stool by the hand for carrying. When the folded stool is grasped by the hand at h, the manner of interconnection of seat supports and leg supports is such that leg supports stay neatly in place inside seat supports with no tendency to unfold even partially. The folded stool remains a neat and compact package for carrying, handling and storing, as shown in FIG. 2.

It is to be noted that in order for the stool to function properly in the folding and unfolding action, sides of seat supports 10, identified as k in FIGS. 1 and 2, and sides of leg supports 22, identified as m in the same figures, must all be parallel. This principle of parallel sides of at least a part of seat supports and leg supports applies to all variations in shape and configuration of frame support members.

MATERIALS OF CONSTRUCTION

The folding stool of the present invention could be made of a variety of materials, but all should be suitable for outdoor use. Frame support members (seat supports and leg supports) could be made of a variety of materials, including but not limited to solid wood or plywood, injection moulded plastic or structural foam, tubular metal of aluminum, steel or alloys, square tube or round tube, or tubing rectangular in cross section, cast aluminum or alloy, or solid heavy gage steel wire. It will be apparent that other variations in materials are possible as well.

Preferred embodiment of supporting members is wood or injection moulded structural foam in polyurethane or polypropylene, hight density polyethylene, or plastic having similar properties. The choice of wood is based on low initial cost of manufacture. Molded plastic in structural foam, for example, would require costly molds which might be prohibitive in initial stages of market development, although product cost in higher quantities would be lower than that of product made of wood. Exotic materials such as compounds made with graphite fibers or alloys such as are used in racing bicycles and superlight aircraft would be preferred for their lightness of weight and their strength to weight ratios, but cost of manufacture would probably be prohibitive from the standpoint of a price supportable in the marketplace.

Cross section of frame members, particularly if moulded in plastic, might be solid or cored, in U-shape or I-beam shape or X-shape, or other such variations. Key considerations in choice of materials for frame support members and shape of cross section of frame support members are: (a) strength and utility, (b) weight, (c) aesthetics, and (d) cost of manufacture.

Frame support members could be made in a variety of shapes and configurations. However, the basic mechanics and function of the present invention as presented and previously described would apply to all variations. Alternative shape variations for frame support members should be compared with the preferred shape as illustrated in FIGS. 1 to 5, especially FIG. 2 which presents what is virtually a plan view of the folded frame parts. FIG. 7 shows six possible variations in shape of frame support members. In this illustration, for the sake of simplification, shapes are shown only for seat supports. Leg supports would essentially repeat the shape of the seat supports inasmuch as they must fit completely within the latter. It should be noted that while possible variations in shape may be many, it is essential from a functional standpoint that sides marked k on seat supports 10 and sides marked m on leg supports 22 (FIGS. 1, 2 and 7) be parallel.

Material used for the seat could be leather, fabric such as duck, synthetic or natural fibers, or plastic, or any material or combination of materials having similar properties of flexibility, strength and utility. The seat could be made of slats of thin rigid or semi-rigid material, more likely of wood or plastic, joined in tambour fashion, or it could be made in two halves of thin rigid or semi-rigid or sheet material pivotally joined in the middle for folding and tucking inside stool frame members. Preferred embodiment of flexible or foldable seat is heavy weight duck in a choice of colors based on marketing considerations. A version might be made of leather.

While method of attachment of seat to seat supports as shown in figures and described above is a preferred embodiment, it is obvious that alternative methods and means of attaching the seat could be used. These include buttons with corresponding button holes or keyhole slots, snap fasteners, hooks with means to attach the hooks, and other variations. However, the embodiment as described and illustrated is preferred for its simplicity and utility.

Continuous hinge 20 could be of non-rusting metal such as brass, stainless steel, aluminum or alloy, or plastic such as nylon, or it could be made of a flexible material such as strong industrial belting rated for minimal elongation. An example of the last is inductrial belting made of a tightly woven polyester fabric encasing a core of polypropylene with a rating of 1% potential elongation. Attachment of hinge 20 could be by means of screws or rivets for metal hinge, or, for hinge made of industrial belting, waterproof contact cement or other strong adhesive with or without staples, pins or rivets, depending on material used for frame support members. Other variations in material for hinge 20 and for its attachment are possible.

If frame support members are made of wood, preferred embodiment of continuous hinge 20 would be brass or stainless steel secured with screws. Potential stresses at point of hinge are such that the strength, rigidity and stability of metal makes this material preferred over alternatives. If support members are made of plastic, hinge 20 could be captive or a living hinge, and hence continuous hinge would be of plastic of appropriate strength and rigidity. Attachment of plastic hinge would be by means appropriate to the materials, including the possible use of mechanical fasteners such as rivets.

Double acting hinge 24 could be made of any flexible material of suitable strength and toughness with minimal potential elongation under stress. Choice of material for frame support members would affect choice of material for the double acting hinge. The preferred embodiment is strong industrial belting material made of tightly woven polyester fabric encasing a flexible core of polypropylene. Attachment may be made by waterproof contact cement or other strong adhesive, conceivably reinforced by pins, rivets or similar means.

Double acting hinge could be made of metal, but higher cost and a more clumsy and bulky appearance would result.

Axles 28 (FIG. 1) could be made of any material which provides appropriate strength, utility and lightness of weight for this application, along with resistance to moisture and rust. Typical embodiments are brass or stainless steel tubing or plastic such as nylon, the choice based essentially on cost. The axles are out of view and must be rust proof and trouble free. While not illustrated, axle holes would be preferably covered with buttons of wood, plastic or metal, depending on material used in making frame support parts. Preferred embodiment of axles is nylon plastic rod with plastic end caps or buttons to cover axle holes.

Washers 28 are used to separate frame support members from each other and to facilitate movement of support members in opening and closing action. Washers could be made of brass, stainless steel, or nylon or other plastic, or other non-rusting material. By reason of function, wearability and cost, the preferred material for washers is nylon.

CONCLUSION, RAMIFICATIONS AND SCOPE OF INVENTION

While my above descriptions and drawings contain many specifics along with some possible variations, these should not be construed as limitations on the scope of the invention, but rather as exemplifications of possible embodiments or preferred embodiments thereof. Other variations not mentioned are possible, including variations in configuration, in materials, in parts, in method of attachment of parts, and the like.

In addition, the invention in one or another of the possible embodiments could be adapted to use as a foldable table, an end table or side table, an occasional table or snack table, or it could be adapted to use as support means for many different items where foldability and compactness of form for portability or for storage are especially desirable, such as on boats and in trailers or campers, and in like uses.

Accordingly, the scope of the present invention should not be determined by embodiments so far discussed, but by the appended claims and their legal equivalents.

In the case of a folding table employing elements and principles set forth in the present invention, the essential difference between the folding table and the folding stool is that the table top would be totally rigid, while stool seat is flexible or foldable. Table top would be so formed as to stay in place when table is open and in use.

I claim:

1. A folding stool comprising in combination a pair of hinged leg supports connected to a pair of hinged seat supports by means of a pair of pivots in such a manner that when folded said leg supports fold up into and fit within said seat supports thus making a compact unit easily carried and stored;

said seat supports are connected by a first hinging means permitting opening of said seat supports to 180°;

said pivots connect said seat supports to said leg supports at points which are intermediate of the respective extremities of said seat and leg supports seat and leg whereby said supports are held in controlled and firm adjustment relative to each other at all stages of folding and unfolding, and whereby said seat supports and said leg supports cross each other at said points of said pivots in substantially X form when said stool is in an open in-use state thus providing firm and sturdy support for an adult user;

said leg supports are connected by a second hinging means comprised of a plurality of flexible strips forming a flexible double acting hinge which permits rotating of said leg supports out of folded state about said pivots over the 180° horizontal allowing said leg supports to extend downward into a position suitable for supporting an adult user;

said pair of leg supports consists of a connected portion;

said pair of leg supports consisting of a protrusion or nose common to both leg supports;

said protrusion or nose constructed to force the connected portion of the leg supports apart when the stool is opened and in position for use;

at least two of the plurality of flexible strips having one end each, attached to a first of the pair of leg supports, and the reverse side of each opposite end attached to the second of the pair of leg supports; at least one of the plurality of flexible strips having one side of one end attached to the second of the pair of leg supports and the opposite end attached to the first of the leg supports;

said pivots connecting said seat supports to said leg supports are disposed at a predetermined distance from said second hinging means said distance calculated to provide a predetermined elevation of said seat at a height comfortable for an adult user, while at the same time providing structural sturdiness of the assembly and compactness of the folded package;

said folding stool has a foldable or flexible seat stretchable across and attachable to top or upper extremity of said seat supports in a manner such that said seat prevents further opening of said folding stool and in combination with said support members will support an adult user;

said foldable or flexible seat and said supporting members are so disposed and so connected and function together in combination in such a manner that said stool in its folded state presents a very compact package of predetermined dimensions and whereby said stool in its open in-use state permits user to sit at a predetermined comfortable height, the dimension describing said height being substantially greater than the dimension describing the extremities of said folded package;

said foldable seat is attached to said seat supports by means permitting convenient and ready conversion of said stool from a folded state to a use state suitable for supporting an adult user;

said folding seat is readily removable and inexpensively replaceable;

said double acting hinge connecting said leg supports is in close proximity to and uppermost relative to said hinging means connecting said seat supports when stool is in its folded state and wherein said double acting hinge moves upward and away from said hinging means connecting said seat supports during unfolding action in which said double acting hinge passes through a line joining and thus describing the location of said pivots, permitting said leg supports to extend downward into a position suitable for supporting an adult user;

said leg supports have incorporated at the point of their hinging means to force leg supports into a more vertical stance when stool is in use, thus adding substantially to the weight supporting capacity of said stool;

the configuration of said support members is such as to provide cutout convenient for grasping of folded stool by the hand for carrying purposes.

2. A folding stool as recited in claim 1 said foldable seat is attached to said seat supports be means of slots or grooves of predetermined dimensions disposed within the tops or upper extremities of said seat supports;

the two ends of said foldable seat have encased within them rigid or semi-rigid stiffening material of predetermined dimensions;

said stiffened seat ends are removably inserted into said slots or grooves whereby said stiffened seat ends after insertion in said slots or grooves form an acute angle with the plane formed by said seat when said seat is stretched tautly across the top or upper extremities of said seat supports thus preventing said seat ends from slipping out of said slots or grooves when said seat is under stress from weight of the user while additionally preventing further opening of stool when it is in use;

said foldable seat is made of leather or duck or synthetic fabric or other material having similar properties of flexibility, strength and durability.

3. A folding stool as recited in claim 1 wherein said seat is made of slats of rigid or semi-rigid material joined together in tambour fashion so as to provide flexibility and foldability suitable for use in said folding stool.

4. A folding stool as recited in claim 1 wherein said seat is made of rigid or semi-rigid sheet material of predetermined composition and thickness, pivotally joined to the seat support so as to make said seat foldable within said seat supports when stool is folded for carrying or storing.

5. A folding stool as recited in claim 1 wherein said seat supports and said leg supports are made of solid wood or plywood.

6. A folding stool as recited in claim 1 wherein said seat supports and said leg supports are made of moulded plastic, including structural foam.

7. A folding stool as recited in claim 1 wherein said seat supports and said leg supports are made of metal, including tubular metal or solid metal, or cast metal or alloys or combinations thereof, including super-light metal alloys made with graphite fibers or carbon fibers or other combinations of materials having similar properties of high strength-to-weight ratios.

8. A folding stool as recited in claim 1 wherein said pivots joining said seat supports to said leg supports comprise metal tubing or metal rod or plastic tubing or plastic rod or other materials having similar properties functioning as axles.

9. A folding stool as recited in claim 1 wherein space is provided suitable for imprinting, impressing or otherwise displaying name or logotype or slogans of advertisers while not adversely affecting the aesthetic appeal of said folding stool.

* * * * *